US010890308B2

(12) United States Patent
Jung et al.

(10) Patent No.: US 10,890,308 B2
(45) Date of Patent: Jan. 12, 2021

(54) CAR LAMP USING SEMICONDUCTOR LIGHT EMITTING DEVICE

(71) Applicant: ZKW Group GmbH, Wieselburg (AT)

(72) Inventors: Mongkwon Jung, Seoul (KR); Joongtaek Cha, Seoul (KR)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/512,932

(22) Filed: Jul. 16, 2019

(65) Prior Publication Data

US 2020/0025348 A1 Jan. 23, 2020

(30) Foreign Application Priority Data

Jul. 17, 2018 (KR) ..... 10-2018-0083052

(51) Int. Cl.

| | |
|---|---|
| ***F21V 21/00*** | (2006.01) |
| ***F21S 41/365*** | (2018.01) |
| ***F21S 43/14*** | (2018.01) |
| ***F21S 41/143*** | (2018.01) |
| ***F21S 41/19*** | (2018.01) |
| ***F21S 43/31*** | (2018.01) |
| ***F21S 43/19*** | (2018.01) |

(52) U.S. Cl.

CPC ..... *F21S 41/365* (2018.01); *F21S 41/143* (2018.01); *F21S 41/192* (2018.01); *F21S 43/14* (2018.01); *F21S 43/195* (2018.01); *F21S 43/31* (2018.01)

(58) Field of Classification Search

CPC ..... F21S 41/365; F21S 43/14; F21S 41/143; F21S 41/192; F21S 43/31; F21S 43/195

USPC ..... 362/516

See application file for complete search history.

(56) References Cited

U.S. PATENT DOCUMENTS

| | | | | |
|---|---|---|---|---|
| 10,422,505 | B2 * | 9/2019 | Lee | F21V 5/002 |
| 2009/0251920 | A1 * | 10/2009 | Kino | B60Q 1/323 362/602 |

(Continued)

FOREIGN PATENT DOCUMENTS

| | | |
|---|---|---|
| DE | 102008029450 | 12/2009 |
| DE | 102015210288 | 12/2015 |

(Continued)

OTHER PUBLICATIONS

Extended European Search Report in European Application No. 19186035.2, dated Sep. 20, 2019, 9 pages.

*Primary Examiner* — Laura K Tso

(74) *Attorney, Agent, or Firm* — Fish & Richardson P.C.

(57) ABSTRACT

The present invention relates to a car lamp (or a vehicle lamp) and a control method thereof, and more particularly, a vehicle lamp using a semiconductor light emitting device. The present invention provides a lamp including a half mirror having an upper surface and a lower surface and configured to reflect a part of light incident on the lower surface and another part to be discharged to outside, a reflector located below the half mirror in a manner of facing the lower surface of the half mirror, and a plurality of light sources located between the half mirror and the reflector to emit light toward the half mirror, wherein the half mirror and the reflector are located to be spaced apart from each other by a predetermined distance such that the light emitted from each of the light sources is repeatedly reflected by the half mirror and the reflector.

12 Claims, 4 Drawing Sheets

(56) References Cited

U.S. PATENT DOCUMENTS

| | | | | |
|---|---|---|---|---|
| 2011/0255294 | A1* | 10/2011 | Okabe | H01L 33/405 362/362 |
| 2015/0055347 | A1* | 2/2015 | Kim | F21K 9/69 362/293 |
| 2015/0062946 | A1* | 3/2015 | Fukai | F21S 43/40 362/516 |
| 2015/0258931 | A1* | 9/2015 | Kim | B60Q 1/2665 362/516 |
| 2015/0258932 | A1* | 9/2015 | Kim | F21S 43/26 362/516 |
| 2015/0345740 | A1* | 12/2015 | Watanabe | F21S 43/30 362/517 |
| 2017/0227183 | A1* | 8/2017 | Cho | F21S 2/00 |
| 2020/0025347 | A1* | 1/2020 | Jung | F21S 41/145 |

FOREIGN PATENT DOCUMENTS

| | | |
|---|---|---|
| JP | 2013214492 | 10/2013 |
| JP | 2014235817 | 12/2014 |
| JP | 2016012554 | 1/2016 |
| KR | 1020090111033 | 10/2009 |
| KR | 1020150092651 | 8/2015 |
| KR | 20180034140 | 4/2018 |

* cited by examiner

CAR LAMP USING SEMICONDUCTOR LIGHT EMITTING DEVICE

CROSS-REFERENCE TO RELATED APPLICATION

Pursuant to 35 U.S.C. § 119(a), this application claims the benefit of an earlier filing date of and the right of priority to Korean Application No. 10-2018-0083052, filed on Jul. 17, 2018, the contents of which are incorporated by reference herein in its entirety.

FIELD

The present invention relates to a car lamp (or vehicle lamp) and a control method thereof, and more particularly, a vehicle lamp using a semiconductor light emitting device.

BACKGROUND

A vehicle or car is equipped with various lamps having lighting functions and signaling functions. In general, halogen lamps or gas discharge lamps are usually used, but in recent years, light emitting diodes (LEDs) are in the spotlight as light sources for vehicle lamps.

The LED can enhance a degree of freedom for design of a lamp by minimizing a size thereof and exhibit economic efficiency by virtue of a semi-permanent lifespan, but most of the LEDs are currently produced in a form of a package. The LED itself other than the package is a semiconductor light emitting device of converting a current into light and is under development as an image displaying light source equipped in an electronic device such as an information communication device.

In recent years, attempts have been made to vary an illumination (lighting) pattern of a lamp as the size of the semiconductor light emitting device decreases. However, in order to realize various illumination patterns, structures in addition to a light source are required, which causes an increase in the size of the lamp, a decrease in brightness, and the like. As a result, various implementations of the illumination pattern of the lamp are limited.

SUMMARY

One aspect of the present invention is to provide a lamp structure capable of realizing a stereoscopic illumination pattern while minimizing a thickness.

To achieve the aspect and other advantages of the present invention, there is provided a car lamp, including a half mirror having an upper surface and a lower surface, and configured to reflect a part of light incident on the lower surface and discharge another part to outside, a reflector located below the half mirror in a manner of facing the lower surface of the half mirror, and a plurality of light sources located between the half mirror and the reflector to emit light toward the half mirror, wherein the half mirror and the reflector are spaced apart from each other by a predetermined distance such that the light emitted from each of the light sources is repeatedly reflected by the half mirror and the reflector.

In one embodiment, the lamp may further include a transparent substrate located between the half mirror and the reflector and spaced apart from the half mirror by a predetermined distance.

In one embodiment, the light sources may be located on one surface facing the half mirror, of both surfaces of the transparent substrate, and the light sources may be spaced apart from one another at predetermined distance.

In one embodiment, some of the light sources may have a light emission area different from a light emission area of the remaining light sources.

In one embodiment, the transparent substrate may be located to be spaced apart from the reflector by a predetermined distance, so as to face the reflector.

In one embodiment, a vertical distance between the transparent substrate and the half mirror may be different from a vertical distance between the transparent substrate and the reflector.

In one embodiment, the lamp may further include metal electrodes located on the transparent substrate to apply a voltage to the light sources, respectively, and the metal electrodes may be located to surround the light sources, respectively.

In one embodiment, the lamp may further include a transparent electrode located on the transparent substrate to apply a voltage to each of the light sources, and made of a light-transmitting material.

In one embodiment, the transparent substrate may be stacked on the reflector, and the lamp may further include an electrode located between the transparent substrate and the reflector and electrically connected to the light sources.

In one embodiment, each of the light sources may be located on the reflector, and the lamp may further include an electrode located on the reflector and electrically connected to the light sources.

In one embodiment, the light sources may be provided with a light-transmitting layer or a reflective film located therebetween.

According to another aspect of the present invention, there is provided a car lamp, including a half mirror having an upper surface and a lower surface, and configured to reflect a part of light incident on the lower surface and discharge another part to outside, a reflector located below the half mirror in a manner of facing the lower surface of the half mirror, and a plurality of light sources located on the upper surface of the half mirror, wherein the half mirror has a partial region made of a light-transmitting material to allow some of light emitted from the light sources to be directed to a lower side of the half mirror, and wherein the light directed to the lower side of the half mirror is repeatedly reflected by the half mirror and the reflection layer.

Effects of the Disclosure

According to the present invention, it is not necessary to arrange light sources three-dimensionally in order to realize a stereoscopic illumination pattern. Accordingly, the present invention can realize the stereoscopic illumination pattern while maintaining a slim thickness of the lamp.

DETAILED DESCRIPTION OF THE PREFERRED EMBODIMENT

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present invention is not limited by the accompanying drawings.

It will be understood that when an element such as a layer, area or substrate is referred to as being "on" another element, it can be directly on the element, or one or more intervening elements may also be present.

A vehicle lamp described in this specification may include a head lamp, a tail lamp, a position lamp, a fog lamp, a turn signal lamp, a brake lamp, an emergency lamp, a backup lamp, and the like. However, it will be readily apparent to those skilled in the art that the configuration according to the embodiments described herein may also be applied to a new product type that will be developed later if the device is a device capable of emitting light.

Figure 1:
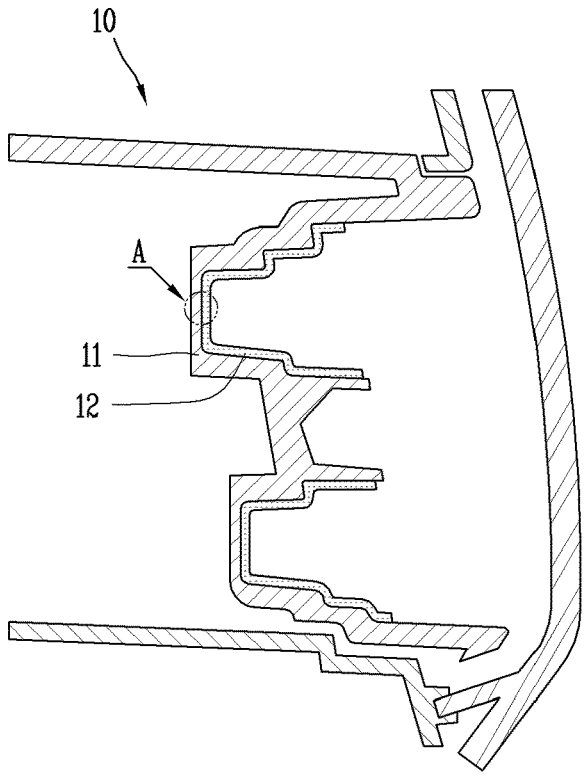
FIG. 1 is a conceptual view illustrating one embodiment of a lamp for a vehicle (a car lamp or a vehicle lamp) using a semiconductor light emitting device according to the present invention.

FIG. 1 is a conceptual view illustrating one embodiment of a lamp for a vehicle (or a vehicle lamp) using a semiconductor light emitting device according to the present invention.

A car lamp (or a vehicle lamp) 10 according to one embodiment of the present invention includes a frame 11 fixed to a vehicle body, and a light source unit 12 installed on the frame 11.

A wiring line for supplying power to the light source unit 12 may be connected to the frame 11, and the frame 11 may be fixed to the vehicle body directly or by using a bracket. According to the present invention, the vehicle lamp 10 may be provided with a lens unit to more diffuse and sharpen light emitted from the light source unit 12.

The light source unit 12 may be a flexible light source unit that can be curved, bent, twisted, folded, or rolled by external force.

In a non-curved state of the light source unit 12 (for example, a state having an infinite radius of curvature, hereinafter, referred to as a first state), the light source unit 12 is flat. When the first state is switched to a state that the light source unit 12 is bent by an external force (e.g., a state having a finite radius of curvature, hereinafter, referred to as a second state), the flexible light source unit may have a curved surface with at least part curved or bent.

A pixel of the light source unit 12 may be implemented by a semiconductor light emitting device. The present invention exemplarily illustrates a light emitting diode (LED) as a type of semiconductor light emitting device for converting current into light. The LED may be a light emitting device having a small size, and may thus serve as a pixel even in the second state.

Figure 2:
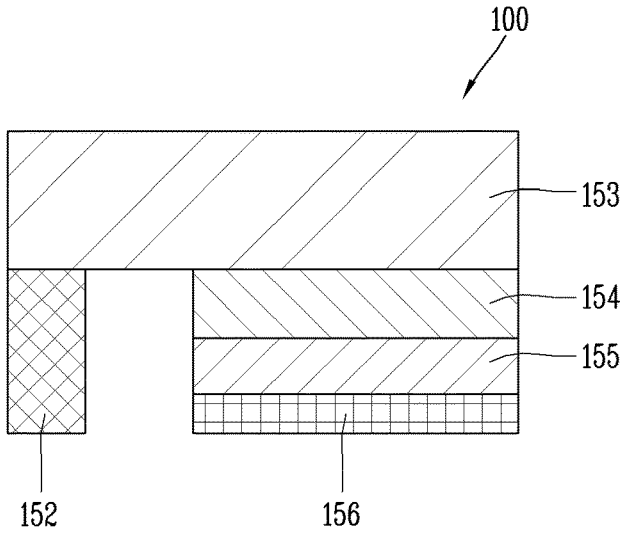
FIG. 2 is a conceptual view illustrating a flip chip type semiconductor light emitting device.
Figure 3:
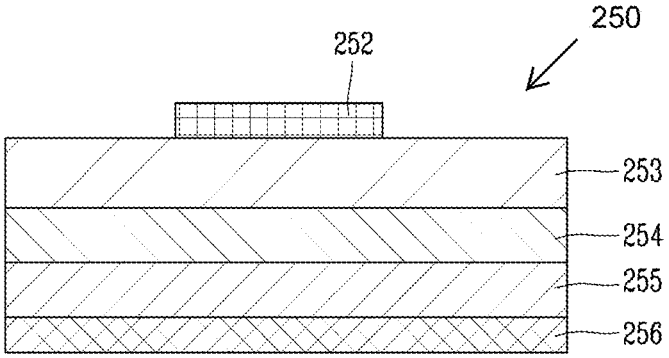
FIG. 3 is a conceptual view illustrating a vertical type semiconductor light emitting device.

FIG. 2 is a conceptual view illustrating a flip chip type semiconductor light emitting device, and FIG. 3 is a conceptual view illustrating a vertical type semiconductor light emitting device.

Since the semiconductor light emitting device 150 has excellent brightness, it can constitute an individual unit pixel even though it has a small size. The individual semiconductor light emitting device 150 may have a size of 80 μm or less on one side, and may be a rectangular or square device. In this case, an area of the single semiconductor light emitting device is in the range of $10^{-10}$ to $10^{-5}$ $m^2$, and an interval between light emitting devices may be in the range of 100 um to 10 mm.

Referring to FIG. 2, the semiconductor light emitting device 150 may be a flip chip type light emitting device.

For example, the semiconductor light emitting device 100 includes a p-type electrode 156, a p-type semiconductor layer 155 on which the p-type electrode 156 is formed, an active layer 154 located on the p-type semiconductor layer 155, an n-type semiconductor layer 153 located on the active layer 154, and an n-type electrode 152 located on the n-type semiconductor layer 153 with being spaced apart from the p-type electrode 156 in a horizontal direction.

Alternatively, the semiconductor light emitting device 250 may have a vertical structure.

Referring to FIG. 3, the vertical type semiconductor light emitting device 250 includes a p-type electrode 256, a p-type semiconductor layer 255 formed on the p-type electrode 256, an active layer 254 formed on the p-type semiconductor layer 255, an n-type semiconductor layer 253 formed on the active layer 254, and an n-type electrode 252 formed on the n-type semiconductor layer 253.

In addition, the plurality of semiconductor light emitting devices 250 constitute a light emitting device array and an insulating layer is interposed between the plurality of light emitting devices. However, the present invention is not necessarily limited thereto, and but alternatively employs a structure in which an adhesive layer fully fills a gap between the semiconductor light emitting devices without the insulating layer.

The insulating layer may be a transparent insulating layer including silicon oxide (SiOx) or the like. As another example, the insulating layer may be formed of epoxy having excellent insulation characteristic and low light absorption, a polymer material such as methyl, phenyl-based silicone and the like, or an inorganic material such as SiN, Al2O3 and the like, in order to prevent shorting between electrodes.

Although the embodiments of the semiconductor light emitting device have been described above, the present invention is not limited to the semiconductor light emitting device but may be alternately realized through various semiconductor light emitting devices.

The lamp according to the present invention provides a structure capable of realizing a three-dimensional (stereoscopic) illumination pattern and simultaneously minimizing a thickness of the lamp.

Figure 4:
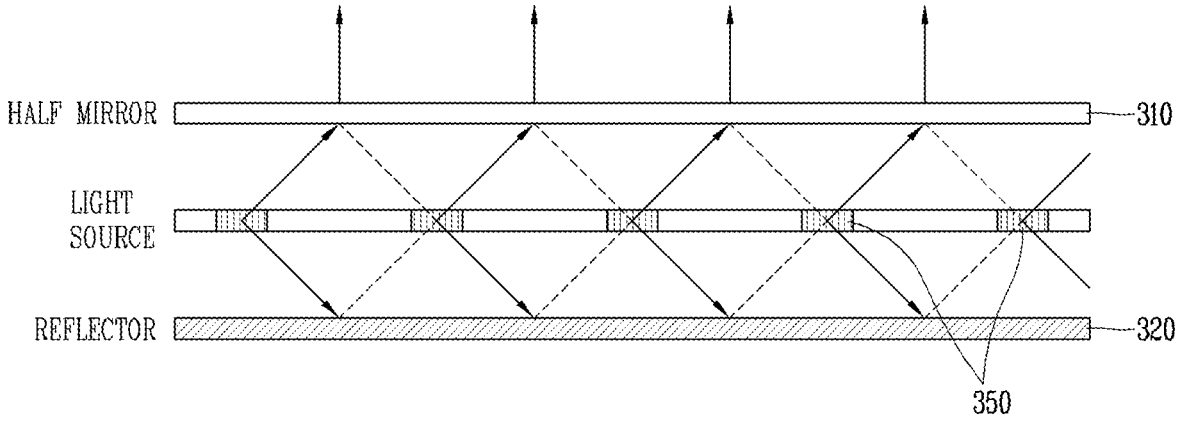
FIG. 4 is a conceptual view illustrating a cross section of a lamp according to the present invention.

FIG. 4 is a conceptual view illustrating a cross section of a lamp according to the present invention.

Referring to FIG. 4, the lamp according to the present invention may include a half mirror 310, a reflector 320, and a plurality of light sources 350. Hereinafter, each of the constituent elements and a coupling relationship between the constituent elements will be described.

First, the half mirror 310 has an upper surface and a lower surface. In this specification, the upper surface of the half mirror 310 is defined as a surface facing an outside. That is, light emitted from the vehicle lamp according to the present invention passes through the upper surface of the half mirror 310 and is discharged to the outside.

The half mirror 310 reflects a part of light incident on the lower surface and another part is discharged to the outside. For example, the half mirror 310 may reflect 50% of the light incident on the lower surface and transmit the remaining light therethrough. Reflectance or transmittance of the half mirror 310 may vary depending on a material of the half mirror 310.

Meanwhile, the half mirror 310 is not necessarily located at the outermost portion of the lamp according to the present invention. Light passing through the upper surface of the half mirror 310 may be discharged to the outside through an additional structure overlapping the upper surface. For example, the lamp according to the present invention may include a lens, a protective layer, and the like which overlap the upper surface of the half mirror 310 and are located at an outer side than the half mirror 310. However, since these additional configurations are well known in the art, a detailed description thereof will be omitted.

Although only the half mirror 310 and components located inside the half mirror 310 are described herein, the present invention does not exclude that additional components are located outside the half mirror 310.

The reflector 320 is located below the half mirror 310 and is located to face the lower surface of the half mirror 310. The light reflected by the reflector 320 is directed to the lower surface of the half mirror 310. The light reflected from the lower surface of the half mirror 310 is directed to the reflector 320. The light which is incident between the reflector 320 and the half mirror 310 may be repeatedly reflected between the half mirror 310 and the reflector 320.

When light is repeatedly reflected between the half mirror 310 and the reflector 320 and then discharged to the outside, various illumination patterns are formed. This results in forming a stereoscopic (three-dimensional) illumination pattern.

Specifically, the lamp according to the present invention is provided with a plurality of light sources 350 located between the half mirror 310 and the reflector 320. Some of light emitted from each of the light sources 350 are repeatedly reflected between the half mirror 310 and the reflector 320 and then discharged to the outside. As a result, such a three-dimensional illumination pattern is formed.

On the other hand, the illumination pattern may be largely divided into two regions. First, one of the two regions is a first region formed at a position adjacent to the light source 350. If there are the plurality of the light sources 350, the first region may be plural. Second, the other region is a region formed around the first region. Since a quantity of light transmitted through the half mirror 310 increases as a distance from the light source 350 is close, brightness of the first region is greater than brightness of the second region. On the other hand, since the second region formed around the first region is formed when light is repeatedly reflected between the half mirror 310 and the reflector 320 and then discharged to the outside, a three-dimensional feeling is given.

Actually, the first and second regions may not be clearly distinguished by the naked eye. In this specification, for convenience of description, a region, which is formed adjacent to the light sources 350, of an entire region of the illumination pattern is referred to as a first region, and a region formed around the first region is referred to as a second region.

A size, interval, and shape of the first region may change according to a method of arranging the light sources 350 between the half mirror 310 and the reflector 320, and a stereoscopic shape of the second region may vary. Hereinafter, various embodiments in which the light sources are located between the half mirror 310 and the reflector 320 will be described.

The plurality of light sources 350 may be located toward the half mirror 310 between the half mirror 310 and the reflector 320. However, the present invention is not limited thereto, and the light sources 350 may alternatively be located toward the reflector 320, but it may be more advantageous that the light sources 350 are located to face the half mirror 310.

Each of the light sources may be the vertical type semiconductor light emitting device or the flip chip type semiconductor light emitting device. Each of the light sources may be an organic light emitting diode.

First, an embodiment in which the light sources are located between the half mirror and the reflector using a transparent substrate will be described.

Figure 5:
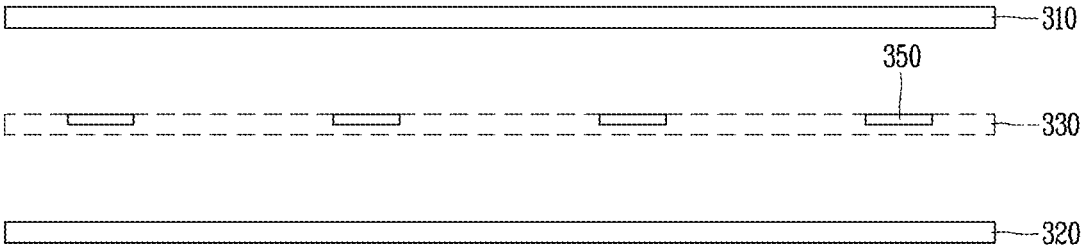
FIG. 5 is a conceptual view illustrating a cross section of a lamp including a transparent substrate according to the present invention.
Figure 6:
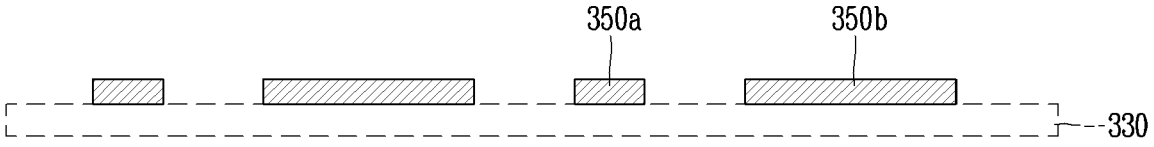
FIG. 6 is a conceptual view illustrating a plurality of light sources having different light emission areas.
Figure 7:
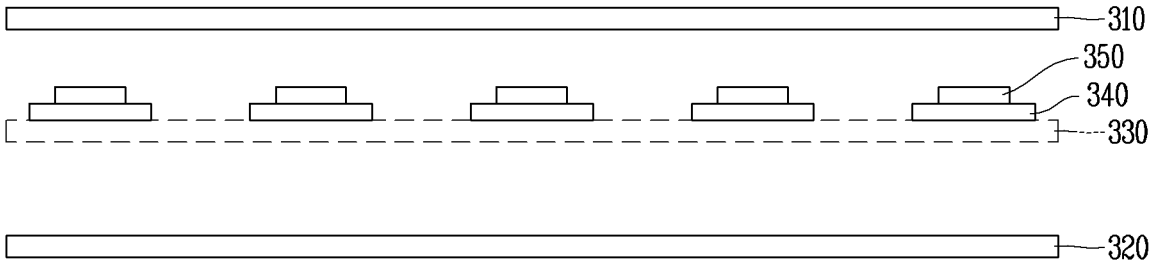
FIG. 7 is a conceptual view illustrating a cross section of a lamp including a metallic reflector according to the present invention.
Figure 8:
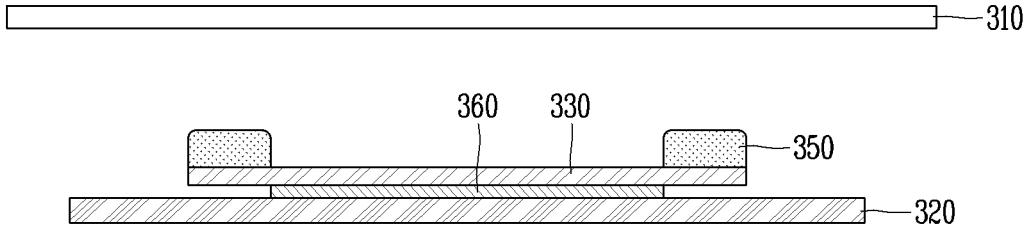
FIG. 8 is a conceptual view illustrating a cross section of a lamp including a transparent substrate stacked on a reflector.

FIG. 5 is a conceptual view illustrating a cross section of a lamp including a transparent substrate, FIG. 6 is a conceptual view illustrating a plurality of light sources each having a different light emission area, FIG. 7 is a conceptual view illustrating a cross section of a lamp including a metallic reflector, and FIG. 8 is a conceptual view illustrating a cross section of a lamp including a transparent substrate stacked on a reflector.

Referring to FIG. 5, the plurality of light sources 350 may be located between the half mirror 310 and the reflector 320 through a transparent substrate 330. In detail, the plurality of light sources 350 is located on the transparent substrate 330 and the transparent substrate 330 is spaced apart from the half mirror 310 by a predetermined distance. A circuit for applying a voltage or a current to each of the light sources 350 may be located on the transparent substrate 330.

Since the transparent substrate 330 transmits light emitted from the light sources 350 therethrough, the light emitted from the light sources 350 may freely move between the half mirror 310 and the reflector 320. Accordingly, the present invention minimizes a light loss that may be caused as the light emitted from each of the light sources 350 is repeatedly reflected by the half mirror 310 and the reflector 320.

The light sources 350 may be located on one surface facing the half mirror 310, of both surfaces of the transparent substrate 330. Accordingly, each of the light sources 350 may be located to face the half mirror 310.

Each of the light sources 350 may be spaced apart from one another on the transparent substrate 330 with predetermined distance. The light sources 350 are uniformly arranged on the transparent substrate 330 so that a quantity of light directed toward the half mirror 310 can be uniform. Thus, the present invention can cause a uniform quantity of light to be emitted from all the light emitting regions of the lamp.

Each of the light sources 350 has a constant light emission area. For example, the vertical type semiconductor light emitting device has a light emission area which corresponds to an area of the active layer. Some of the light sources may have a different light emission area from the light emission area of the remaining light sources.

In one embodiment, referring to FIG. 6, a light source 350*a* having a first light emission area and a second light emission area 350*b* having a second light emission area larger than the first light emission area may be located in a combining manner between the half mirror 310 and the reflector 320. When the two types of light sources are arranged alternately, an illumination pattern in which the areas of the first regions repeatedly increase and decrease.

In another embodiment, the light sources may be arranged in a manner that the light emission area increases in one direction. As a result, a quantity of emitted light can gradually increase along the one direction, and an illumination pattern capable of giving a three-dimensional effect can be realized.

The transparent substrate may be located to be spaced apart from the reflector by a predetermined distance or stacked on the reflector.

First, one embodiment in which the transparent substrate is spaced apart from the reflector by a predetermined distance will be described.

As illustrated in FIG. 5, the transparent substrate 330 may be located to be spaced apart from the reflector 320 by a predetermined distance so as to face the reflector 320. The transparent substrate 330 may be spaced apart from the half mirror 310 by a predetermined distance and also spaced apart from the reflector 320 by a predetermined distance. Since an optical path varies depending on the distance between the half mirror 310 and the transparent substrate 330 and the distance between the reflector 320 and the transparent substrate 330, the illumination pattern can be variously realized by changing the distances.

When the transparent substrate 330 is spaced apart from the half mirror 310 and the reflector 320, respectively, a vertical distance between the transparent substrate 330 and the half mirror 310 may be different from a vertical distance between the transparent substrate 330 and the reflector 320. The illumination pattern may vary depending on the vertical distance between the transparent substrate 330 and the half mirror 310 and the vertical distance between the transparent substrate 330 and the reflector 320.

In one embodiment, the illumination pattern may change by adjusting the distance between the transparent substrate 330 and the half mirror 310 or the reflector 320. In detail, the lamp according to the present invention may further include a driving unit for moving the transparent substrate 330 in a direction perpendicular (vertical) to the upper surface of the reflector 320 or the lower surface of the half mirror 310. The driving unit may change the optical path by perpendicularly moving the transparent substrate 330. Thus, the illumination pattern can vary.

On the other hand, the present invention provides a structure for increasing brightness of the first region of the illumination pattern.

Referring to FIG. 7, in order to increase the brightness of the first region, the present invention increases a quantity of light that is emitted from the light source 350 and directed to the half mirror 310. Specifically, the present invention may further include metal electrodes 340 located on the transparent substrate 330 to apply a voltage to the light sources 350, respectively. Each of the metal electrodes 340 is located to surround the light source 350 so as to reflect light directed toward a lower side of the light source 350, namely, light directed toward the reflector 320.

For this, the metal electrode 340 may be made of a material having high reflectance. Since electric conductivity of the metal electrode 340 is higher than that of a transparent electrode, the brightness of the light source can increase. Also, since the metal electrode 340 reflects light to increase a quantity of light directed toward the half mirror 310, brightness of the first region increases. Thus, the present invention effectively increases brightness of the lamp.

On the other hand, the present invention provides a structure for allowing brightness of an entire region of an illumination pattern to be uniform without increasing the brightness of the first region.

Specifically, the lamp according to the present invention may include a transparent electrode located on the transparent substrate 330 to apply a voltage to each of the light sources and made of a light-transmitting material. The transparent electrode transmits therethrough light that is emitted from the light source and directed to the reflector or light that is reflected by the half mirror 310 and directed to the reflector 320. Therefore, light is freely reflected between the half mirror 310 and the reflector 320, and a boundary between the first and second regions becomes vague.

As described above, according to the present invention, the transparent substrate is spaced apart from the reflector by the predetermined distance, so that light can proceed even between the transparent substrate and the reflector.

On the other hand, the present invention provides a structure for stacking the transparent substrate on the reflector.

FIG. 8 is a conceptual view illustrating a cross section of a lamp including a transparent substrate stacked on a reflector.

Referring to FIG. 8, the transparent substrate 330 may be stacked on the upper surface of the reflector 320 without spacing from the reflector 320. In one embodiment, a metal electrode 360 for applying a voltage to each of the light sources 350 may be located on the reflector 320 and the transparent substrate 330 may be stacked on the metal electrode 360. According to the structure, since there is no spacing between the transparent substrate 330 and the reflector 320, a thickness of the lamp can be reduced.

As described above, the plurality of light sources 350 may be located between the half mirror 310 and the reflector 320 through the transparent substrate 330. This structure can improve light uniformity of the lamp because the light sources can be uniformly arranged on an entire light emitting surface of the lamp.

On the other hand, the light sources may be arranged between the half mirror and the reflector without the transparent substrate.

Figure 9:
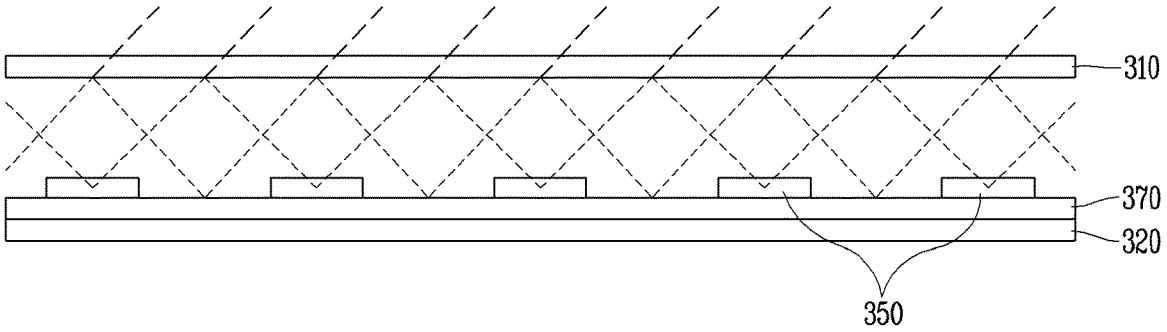
FIGS. 9 and 10 are conceptual views illustrating a cross section of a lamp having a structure in which light sources are stacked on a reflector.
Figure 10:
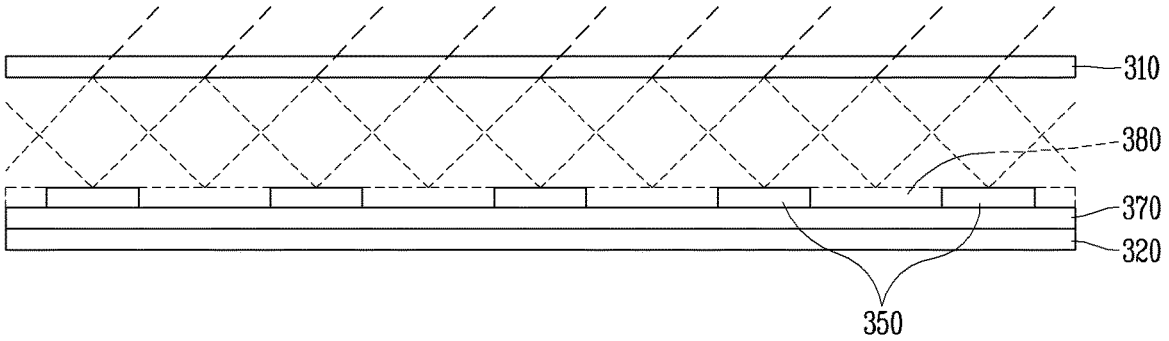

FIGS. 9 and 10 are conceptual views illustrating a cross section of a lamp having a structure in which light sources are stacked on a reflector.

In one embodiment, referring to FIG. 9, each of the light sources 350 may be fixed on the reflector 320. At this time, an electrode 370 for applying a voltage to each of the light sources 350 may be provided on the reflector 320. When the reflector 320 is made of a metal, an insulating adhesive layer may be located between the electrode 370 and the reflector 320 to insulate the reflector 320 and the electrode 370 from each other. The insulating adhesive layer fixes the electrode 370 on the reflector 320 and simultaneously prevents a current from flowing to the reflector 320.

Meanwhile, referring to FIG. 10, when the light sources 350 are fixed on the reflector 320, a reflective film for reflecting light or a light-transmitting layer 380 for scattering light may be provided between the light sources 350.

The reflective film reflects light, which is emitted from the light sources and directed to sides of the light sources, such that the light can be concentrated onto the upper side of the light sources. The brightness of the first region of the illumination pattern increases if the reflective film is used.

Meanwhile, the light-transmitting layer plays a role of scattering light so that the light can be uniformly spread to the entire half mirror. The brightness of the entire illumination pattern becomes uniform if the light-transmitting layer is used.

If both the reflective film and the light-transmitting layer are used, various illumination patterns of the lamp can be formed.

Meanwhile, the present invention provides a structure in which some of light emitted from light sources are directly discharged to outside without passing through a half mirror, and the remaining light is repeatedly reflected between the half mirror and a reflector and then discharged to the outside.

Figure 11:
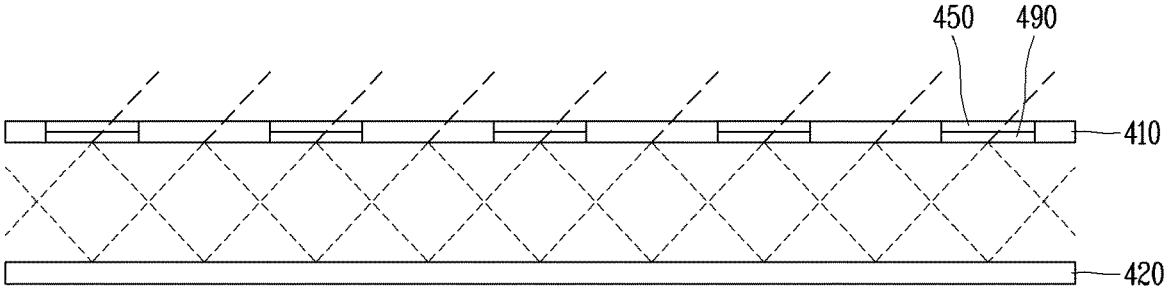
FIG. 11 is a conceptual view illustrating a cross section of a lamp in which a plurality of light sources is arranged on an upper surface of a half mirror.

FIG. 11 is a conceptual view illustrating a cross section of a lamp in which a plurality of light sources is arranged on an upper surface of a half mirror.

Specifically, the present invention provides a car lamp, which includes a half mirror 410 having an upper surface and a lower surface and configured to reflect some of light incident on the lower surface and discharge the remaining light to outside, a reflector 420 located below the half mirror 410 to face the lower surface of the half mirror 410, and a plurality of light sources 450 located on the upper surface of the half mirror 410. A partial region of the half mirror 410 is made of a light-transmitting material 490 such that some of the light emitted from the light sources 450 are directed to a lower side of the half mirror 410. The light directed to the lower side of the half mirror 410 is repeatedly reflected by the half mirror 410 and the reflector 420.

As described above, the light sources 450 are located on the upper surface of the half mirror 410, and this may allow most of the light emitted from the light sources 450 to be directly discharged to the outside without passing through the half mirror 410.

On the other hand, the partial region of the half mirror 410 is made of the light-transmitting material 490, and the light sources 450 are located on the region made of the light-transmitting material 490. Some of the light emitted from the light sources 450 pass through the light-transmitting material 490, are repeatedly reflected between the half mirror 410 and the reflector 420, and then are discharged to the outside.

This may result in forming a stereoscopic illumination pattern around the light source unit. Accordingly, the present invention can realize the stereoscopic illumination pattern while securing a quantity of light of the lamp which is a predetermined level or more.

It will be apparent to those skilled in the art that the present invention may be embodied in other specific forms without departing from the spirit or essential characteristics thereof.

Therefore, it should also be understood that the above-described embodiments are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A car lamp, comprising:

a half mirror having an upper surface and a lower surface, the half mirror being configured to reflect a part of light incident on the lower surface and discharge another part to an outside;

a reflector that is located below the half mirror and that faces the lower surface of the half mirror;

a transparent substrate that is located between the half mirror and the reflector and that is spaced apart from the half mirror by a predetermined distance;

a plurality of light sources that are located on the transparent substrate, that are located between the half mirror and the reflector, and that are configured to emit light toward the half mirror; and metal electrodes located on the transparent substrate and configured to reflect light emitted from the light sources toward the half mirror, each of the metal electrodes covering at least a portion of one of the light sources and being configured to apply a voltage to the one of the light sources, wherein the half mirror and the reflector are spaced apart from each other by a predetermined distance such that the light emitted from each of the light sources is repeatedly reflected by the half mirror and the reflector, wherein each of the light sources is located on the reflector, wherein the lamp further comprises an electrode located on the reflector and electrically connected to the light sources, and wherein the light sources include a reflective film located between two of the light sources.

2. The lamp of claim 1, wherein the light sources are located on one surface facing the half mirror, of both surfaces of the transparent substrate, and wherein the light sources are spaced apart from one another at predetermined distance.

3. The lamp of claim 2, wherein some of the light sources have a light emission area different from a light emission area of the remaining light sources.

4. The lamp of claim 1, wherein the transparent substrate is located to be spaced apart from the reflector by a predetermined distance, so as to face the reflector.

5. The lamp of claim 4, wherein a vertical distance between the transparent substrate and the half mirror is different from a vertical distance between the transparent substrate and the reflector.

6. The lamp of claim 1, further comprising a transparent electrode located on the transparent substrate to apply a voltage to each of the light sources, and made of a light-transmitting material.

7. The lamp of claim 1, wherein the transparent substrate is stacked on the reflector, and wherein the lamp further comprises an electrode located between the transparent substrate and the reflector and electrically connected to the light sources.

8. The lamp of claim 1, wherein the light sources include a light-transmitting layer located between two of the light sources.

9. A car lamp, comprising:

a half mirror having an upper surface and a lower surface, and configured to reflect a part of light incident on the lower surface and discharge another part to outside;

a reflector located below the half mirror in a manner of facing the lower surface of the half mirror; and a plurality of light sources located on the upper surface of the half mirror, wherein the half mirror has a partial region made of a light-transmitting material to allow some of light emitted from the light sources to be directed to a lower side of the half mirror, and wherein the light directed to the lower side of the half mirror is repeatedly reflected by the half mirror and the reflector.

10. The lamp of claim 1, wherein the metal electrodes are located between the transparent substrate and the light sources, and wherein each of the metal electrode is in contact with the substrate and covers an entire portion of a lower surface of one of the light sources.

11. The lamp of claim 1, wherein each of the metal electrodes is configured to reflect light emitted from one of the light sources toward the half mirror.

12. The lamp of claim 1, wherein each of the metal electrode has:

an upper surface that is in contact with one of the light sources and that faces the half mirror; and a lower surface that is in contact with the transparent substrate and that faces the reflector.

* * * * *